US005613738A

United States Patent [19]

Britton

[11] Patent Number: 5,613,738

[45] Date of Patent: Mar. 25, 1997

[54] RESTRAINING APPARATUS FOR A CHAIR AND METHOD OF MAKING SAME

[76] Inventor: James E. Britton, 2641 E. Stanford, Springfield, Mo. 65804

[21] Appl. No.: 437,823

[22] Filed: May 9, 1995

[51] Int. Cl.[6] ..... A62B 35/00

[52] U.S. Cl. ..... 297/467; 297/487

[58] Field of Search ..... 297/467, 256.15, 297/487, 488

[56] References Cited

U.S. PATENT DOCUMENTS

| | | |
|---|---|---|
| 3,891,229 | 6/1975 | Gaffney . |
| 4,022,136 | 5/1977 | Schott . |
| 4,045,051 | 8/1977 | Igarashi et al. . |
| 4,170,991 | 10/1979 | Kella . |
| 4,360,213 | 11/1982 | Rudwick et al. . |
| 4,427,210 | 1/1984 | Wevers . |
| 4,493,488 | 1/1985 | Panaia et al. . |
| 4,574,901 | 3/1986 | Joyner . |
| 4,579,390 | 4/1986 | Guille . |
| 4,593,929 | 6/1986 | Williams . |
| 4,640,658 | 2/1987 | Webb, Jr. . |
| 4,711,489 | 12/1987 | Krause . |
| 4,807,937 | 2/1989 | Harrigan . |
| 4,826,193 | 5/1989 | Davis . |
| 4,951,766 | 8/1990 | Basedow et al. . |
| 4,988,114 | 1/1991 | Thornton, Jr. et al. . |
| 5,042,878 | 8/1991 | Collins . |
| 5,050,899 | 9/1991 | Stensby . |
| 5,286,046 | 2/1994 | Bottemiller et al. . |

*Primary Examiner*—Peter M. Cuomo
*Assistant Examiner*—Stephen Vu
*Attorney, Agent, or Firm*—Jonathan A. Bay

[57] ABSTRACT

A restraining device for a wheelchair and method of making the restraining device. A pummel, or wedge-like element, is rotatably mounted to an elongate axis member. The elongate axis member has engaging elements at each end for engaging the frame or legs of a chair or wheelchair. The elongate axis member is longitudinally adjustable and the engaging elements are rotatably adjustable. The rotatable pummel may be releasably secured to the elongate axis member in a restraining position located proximate an upper, frontal portion of the seat of the chair upon which the restraining device is utilized. In this way, the restraining device is positioned between the legs and at the crotch of an individual seated in the chair. The pummel may be released and rotated about the elongate axis member to a non-restraining position which does not inhibit movement to or from the seat of the chair.

11 Claims, 1 Drawing Sheet

3.
3.

RESTRAINING APPARATUS FOR A CHAIR AND METHOD OF MAKING SAME

BACKGROUND OF THE INVENTION

1. Field of the Invention

The present invention is generally directed to a device for restraining an occupant in a wheelchair. More specifically, the present invention is directed to a device, for restraining a wheelchair occupant, of a type having an element positioned between the legs of the occupant.

2. Description of the Related Art

The need to prevent individuals requiring the use of a wheelchair from slipping or falling from the chair are readily appreciated and well recognized. Numerous prior art attempts have been made to develop a product capable of adequately restraining an occupant in a wheelchair.

One conventional method of restraining an occupant in a wheelchair is through the use of straps or bibs engaged with the chair and wrapped about various portions of the individual seated in the chair. U.S. Pat. Nos. 4,170,991, 4,807,937, and 5,042,878 illustrate these bib or jumpsuit-type restraint systems. These types of prior art wheelchair restraint devices are undesirable in several circumstances. For instance, when the chair, to which a bib-like restraint device is attached, is desired to be used without the restraint, the bib must be removed, or perhaps draped over the back of the chair or rested on by the occupant, the latter choice reducing the comfort of the individual in the chair. Furthermore, positioning occupants in, and removing occupants from, these types of restraints can often be difficult, cumbersome, and frustrating for the occupant of the chair and those assisting the occupant. Moreover, many of these types of devices reduce the upper-body mobility of the wheelchair occupant, and are therefor excessively prohibitive for some individuals.

It is also known to provide a wheelchair restraining device in the form of a pummel or wedge positioned between the legs, and at the crotch, of a wheelchair occupant. Such a pummel serves to prevent a wheelchair occupant from sliding out of the chair, while preventing reduced mobility and accessibility of the wheelchair occupant. Such a device, if a substantially stationary type, is shown in U.S. Pat. No. 4,579,390. A primary drawback of a restraining device of this type is in the difficulty an individual has in positioning himself or herself into or out of the chair.

To overcome the drawbacks of the stationary pummel-type restraining devices as shown in U.S. Pat. No. 4,579,390, movable and positionable pummels have been developed. Such a device is shown in the *Travel Chair* brochure of Ortho-Kinetics, Inc. The pummel device of the Ortho-Kinetics Travel Chair is not readily adaptable to a multitude of wheelchairs. Moreover, the device requires excessive motion and steps to position it in place.

Accordingly, the need exists for a pummel-type wheelchair restraining device that is readily adaptable to a plurality of wheelchair types and sizes. Moreover, the need exists for a pummel-type wheelchair restraint device which is easily locked into position, but which may also easily be positioned in an out-of-the-way location so that an individual may be easily seated or removed from the chair. The present invention overcomes the drawbacks of the prior art and fills these and other needs.

SUMMARY OF THE INVENTION

It is an object of the present invention to provide a wheelchair restraining device which is easy and inexpensive to manufacture.

It is also an object of the present invention to provide a pummel-type wheelchair restraining device, for positioning between the legs and proximate the crotch of a wheelchair occupant, which device is readily adaptable to a plurality of wheelchair types and sizes.

It is a further object of the present invention to provide a pummel-type wheelchair restraining device, for locking into position between the legs and proximate the crotch of a wheelchair occupant, which device is easily unlocked and moved to a position which will not inhibit an occupant from being positioned into the chair or removed from the chair.

These and other objects are achieved by a pummel rotatably mounted on an axis, the pummel for positioning at a location between the legs of a wheelchair occupant. Particularly, the pummel of the present invention serves as a wedge for positioning between the legs of a wheelchair occupant. The pummel is rotationally mounted on an axis, the outer ends of which engage with the frame (or legs) of a chair or wheelchair.

In operation, the pummel is positioned at substantially the center of the axis upon which it is mounted. The pummel is rotatable between a first position generally above, and proximate a frontal center edge of, the seat portion of the chair, and a second position generally 180° from the first position. In other words, the pummel is rotatable from the first position, at which it serves to restrain an occupant in the wheelchair, to a second position generally below the seat section of the chair. In its lower position, the pummel does not block access to or from the chair and, accordingly, individuals may be easily moved to and from the chair without the necessity of completely removing the restraining device. Components are provided for releasably securing the pummel in the restraining position so that the pummel, when secured in the restraining position, is not moved by forces applied thereto.

The axis upon which the pummel is rotatably mounted is an elongate member having brackets at each end. The brackets engage with the frame of the chair upon which the restraining device is utilized. Specifically, conventional wheelchair devices have upright legs at the front two corners of the seat section of the chair. The brackets of the present invention are adapted to engage with these upright members. Additionally, the brackets are rotatable and may be secured in one of a plurality of fixed resting positions. In this way, the brackets are rotatable to receive leg members or frame portions disposed at various angles relative to the seat section of the chair. Additionally, the elongate axis member upon which the pummel is rotatably mounted is adjustable along its length so that it may be utilized on chairs and wheelchairs of various widths.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figures 1, 2, 3, 4:
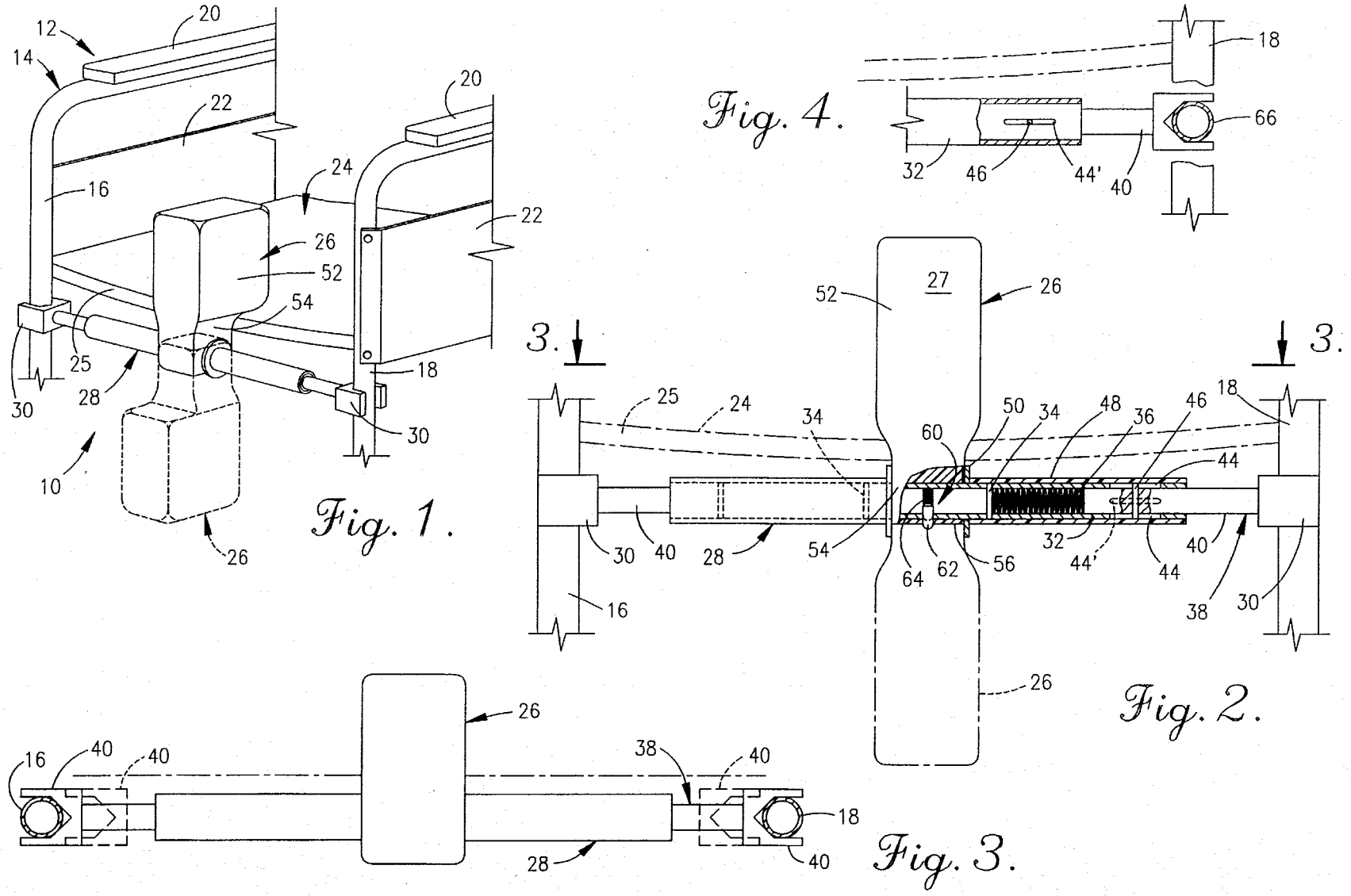
FIG. 1 is a perspective view of the pummel-type restraining device of the present invention in a restraining position on a chair.
FIG. 2 is a front elevational view of the pummel-type restraining device of the present invention showing the positions of the pummel in a restraining position and, alternatively in a non-restraining position.
FIG. 3 is a top plan view taken along lines 3—3 of FIG. 2.
FIG. 4 is a fragmentary view of one end of the elongate axis member of the present invention upon which the pummel is rotatably mounted, specifically illustrating a bracket of the present invention rotated to receive a substantially horizontal frame portion.

With reference initially to FIG. 1, the restraining device of the present invention is denoted generally by the reference number 10 and is located on a chair (only a portion of which is shown), denoted generally by the reference number 12. Chair 12 may be a conventional stationary chair or a wheelchair. Chair 12 has a frame 14. It will be appreciated that the frame 14 of the chair 12 may be constructed in a variety of ways. Frame 14, as shown, has upright leg members 16 and 18, respectively, located at opposite sides of a frontal portion of chair 12. Chair 12 also has arm rests 20, side panels 22 and seat portion 24. The remainder of the chair (not shown) will be readily understood by those skilled in the art and could comprise various configurations.

It will be appreciated that numerous types of chairs are available, and that the present invention is not intended to be limited to a specific type of chair. The present invention is intended for use when it is necessary to restrain an individual in a chair, as is often the case with wheelchairs. Accordingly, the restraining device 10 of the present invention is particularly useful with wheelchairs, including collapsible wheelchairs. In this regard, most conventional wheelchairs have first and second frame portions at the front of the chair 12 and at opposite sides of a seat portion 24. The first and second frame portions may be upright (e.g., 16, 18), horizontal, diagonal or disposed at other angles relative to the substantially horizontal seat section 24.

Restraining device 10 has a pummel 26 rotationally mounted on an elongate axis member, generally denoted by reference number 28. Pummel 26 is substantially centrally disposed on elongate axis member 28. As shown in FIG. 1, and as described in greater detail below, pummel 26 is rotatable about elongate axis member 28 between a first position generally above seat portion 24, and a second position generally below seat portion 24, as shown in broken lines. Elongate axis member 28 includes bracket members 30 at each end for engaging with the frame 14 of chair 12.

With reference now to the front elevational view of FIG. 2, showing portions of restraining device 10 broken away for illustrating internal components thereof, elongate axis member 28 has a first, inner conduit, denoted by reference numeral 32. Inner conduit 32 is preferably one unitary piece of material formed of plastic, PVC material, or metal. As shown, conduit 32 extends through pummel 26.

Reference is now made primarily to the right side of FIG. 2, showing portions of restraining device 10 broken away for illustration. The left side of restraining device 10 as shown in FIG. 2 is constructed in the same manner.

A roll pin 34 is positioned through aligned apertures in first conduit 32. A spring 36 is inserted into the open end of inner conduit 32 until a first-inserted end of the spring abuts up against roll pin 34. A bracket and arm assembly denoted generally by the reference numeral 38 is positioned in inner conduit 32 as shown. Specifically, assembly 38 comprises an arm portion 40 which snugly fits into inner conduit 32. As shown, the innermost end of arm portion 40 abuts against the outermost end of spring 36. A bracket 30 is located at the outermost end of bracket and arm assembly 38. Bracket 30 engages frame 14, and specifically upright leg portion 18 of chair 12.

Inner conduit member 32 has a pair of slots 44 therein, the slots 44 of the pair being oppositely disposed on conduit 32 and aligned with each other. A roll pin 46 is fixedly secured through arm portion 40 of assembly 38. As shown, the outermost ends of roll pin 46 extend outwardly from arm portion 38 and are received in slots 44 of arm 40. Additional pairs of slots 44' are preferably located at 180° from each other about inner conduit 32. One such pair 44' is shown in dashed lines. In this way, roll pin 46 may be removed, the bracket and arm assembly 38 rotated, and the roll pin reinserted through a different pair of slots 44 so that bracket 42 might receive a frame portion or leg member disposed at an angle other than upright. An example is shown in FIG. 4, wherein arm and bracket assembly 38 has been rotated so that bracket 42 receives a horizontal frame member 66. The arrangement of slots 44 and pin 46 permits the outer ends of elongate axis member 28, and particularly the arm and bracket assembly 38 at each end thereof to be compressed against the resistance of springs 36. In this way, the device 10 is inserted between first and second frame portions 16, 18 and the springs are permitted to uncoil, the brackets 30 are forced into engagement with portions 16, 18. FIG. 3 is illustrative of the longitudinally adjustable elongate axis member 28. It will be appreciated that device 10 may be constructed so that only one of the arm and bracket assemblies 38 is adjustable, the other being fixed.

An outer conduit 48 is positioned about inner conduit 32. As can be seen, outer conduit 48 does not extend through pummel 26 and, accordingly, outer conduit 48 is split into two portions for covering respective portions of inner conduit 32 that are external of pummel 26. Roll pins 34 and 46 are of a length such that they do not extend outwardly beyond the peripheral edge of inner conduit 32. Outer conduit 48 snugly fits about inner conduit 32. Outer conduit 48 abuts up against washer 50 and serves to hold washer 50 in place. As discussed, the opposite side of elongate axis member 28 of restraining device 10, illustrated as the left portion as shown in FIG. 2, is constructed in the same manner and, accordingly, the specification for the left portion of the device 10 is not repeated.

Pummel 26 may be constructed of any suitable material. As shown, pummel 26 is made of wood and has a covering 27, preferably made of vinyl. However, other available materials, such as plastic, PVC, rubber, metal, etc., could be utilized in the construction of pummel 26. As shown best in FIG. 1, pummel 26 preferably has a large head portion 52 and a neck portion 54. A channel is formed through neck portion 54 of pummel 26 for receiving inner conduit 32. The channel through neck portion 54 of pummel 26 is dimensioned so that inner conduit 32 fits snugly therein. It will be appreciated that the channel through neck portion 54 of pummel 26 may be constructed by boring through wood or, with plastics or other moldable material, by molding the channel therein. Alternatively, a recess can be formed in the base of neck 54, conduit 32 positioned therein, and a plate or panel, as represented by reference numeral 56 in FIG. 3, positioned over the recess and conduit 32 therein. In the preferred embodiment, the pummel is formed of wood, a recess is formed in the neck portion thereof, and a metallic plate 56 is positioned over the recess after inner conduit 32 is positioned in the recess. It will be appreciated that numerous variations can be made to pummel 26 without departing from the principles of the present invention. It will be understood that when inner conduit 32 is positioned through a channel in pummel 26, reference numeral 56 refers to the base of pummel 26 remaining after the necessary boring or molding operation.

Panel 56 has an aperture formed therein at a substantially central location in panel 56. Inner conduit 32 also has an aperture therein at substantially a central location on conduit 32, which is adapted to align with the aperture in panel 56 when pummel 26 is in a position for restraining an occupant in wheelchair 12. A push button assembly 60 comprised of a button head 62 and a spring base 64 is positioned as shown in FIG. 2. Particularly, button head 62 is secured to one end of spring base 64. The opposite end of spring base 64 is secured to the inner wall of inner conduit 32. The push button assembly 60 is arranged such that, in its non-compressed resting state, it will extend outwardly beyond the periphery of plate 56 through the aperture therein, when the aperture in plate 56 is aligned with push button assembly 60.

The preferred method of making restraining device 10 is now described.

The elongate axis member 28 and pummel 26 are preferably formed separately. Pummel 26 may be formed of any suitable material, such as a block of wood. A recess is formed in neck portion 54 of pummel 26. Alternatively, a channel may be formed therethrough. A suitable covering 27 is secured about pummel 26. The covering is preferably vinyl or some other non-absorbing material, and preferably includes a cushioned inner surface. In this regard, foam or other cushioning material may be positioned between the vinyl covering and the inner portion of pummel 26.

Inner conduit 32 is provided, and apertures are formed therein for receiving roll pins 34. Additionally, slots 44, or pairs thereof, are formed in conduit 32 proximate each end thereof. Additionally, an aperture for receiving push button assembly 60 is formed at a substantially central location on conduit 32. The aperture for receiving push button assembly 60 is preferably longitudinally aligned between a first slot 44 at one end of conduit 32 and a second conduit 44 at the other end of conduit 32.

Conduit 32, thus formed, is positioned into the recess formed in neck portion 54 of pummel 26. Plate 56, having a central aperture formed therein, is secured over the recess and conduit 32 therein. The central apertures in plate 56 and inner conduit 32 are aligned and push button assembly 60 is inserted into the aligned apertures such that spring base 64 thereof engages with the inner side surface of conduit 32 and button head 62 protrudes from the aperture in plate 56. Washers 50 are positioned over each end of conduit 32 in an abutting relationship with pummel 26. Roll pins 34 are positioned in the appropriate apertures and springs 36 are inserted into each end of inner conduit 32. Arms 40 are inserted into each end of inner conduit 32. Roll pins 46 are positioned, through slots 44 in inner conduit 32, into arms 40. Outer conduit portions 48 are slid over arms 40 and inner conduit 32 into an abutting relationship with washers 50. Brackets 42 are connected to arms 40 in any suitable manner.

In operation, pummel 26 is rotatable between a first position, at which pummel 26 is useful for restraining an occupant in chair 12, and a second non-restraining position. As shown in FIGS. 1–3, when pummel 26 is positioned in the first, restraining position, pummel 26 is generally positioned above a frontal, central portion of seat section 24 of chair 12. Specifically, the neck portion 54 of pummel 26 extends upwardly past the front edge 25 of seat portion 24, and a head portion 52 of pummel 26 extends upwardly past the edge 25 of seat portion 24. Moreover, the configuration of pummel 26 and, namely, neck portion 54 and head portion 52 thereof, is such that head portion 52 of pummel 26 is in an overlying relationship with respect to seat portion 24 of chair 22, when pummel 26 is in a restraining position. In this way, pummel 26 is positioned between the legs, and proximate the crotch, of an occupant in chair 12, thereby preventing the occupant from sliding out of, or down too far in, chair 12. As illustrated in FIG. 3, when pummel 26 is in the restraining position, central apertures in plate 56 and inner conduit 32 are aligned and button head 60 extends therethrough, thereby releasably retaining pummel 26 in the restraining position.

When it is desired to move pummel 26 from the restraining position to its non-restraining position, which is generally 180° about elongate axis member 28, button head 60 is depressed to a point at which it no longer engages with plate 56, and pummel 26 is manually rotated to the non-restraining position. It will be appreciated that, once button head 60 is depressed inwardly of plate 26, and movement of pummel 26 is initiated, the outermost tip of button head 60 will be forced by coil 64 against the inner surface of the recess or channel of pummel 26 in which conduit 32 rests. When pummel 26 is in its downward, non-restraining position, occupants can be easily moved into and out of chair 12, without the necessity of entirely removing restraining device 10 from chair 12. When it is desired to position pummel 26 in the restraining position, pummel 26 is rotated about elongate axis member 28 until the central apertures in plate 56 and inner conduit 32 are aligned and, hence, button head 60 is forced through the aperture in plate 56 as coil 64 springs to its resting state.

Restraining device 10 of the present invention is highly useful for restraining an occupant in a chair 12, without unnecessarily restricting the upper body mobility of the occupant. Additionally, restraining device 10 has the highly desirable features of being movable to an out-of-the-way location, without the necessity of entirely removing restraining device 10 from the chair 12.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A combination of a chair with a device for restraining an occupant in the chair, said chair having a frame and a seat on said frame, said frame having first and second frame portions proximate opposite sides of said seat, and said seat having a front edge; said restraining device comprising:

an elongate member, axially disposed between said first and second frame portions, for engaging said frame;

a pummel, rotatably mounted on said elongate member, for rotation about said elongate member between a first position at the front edge and above said seat, and a second position lower than said seat, said pummel being shaped and arranged such that, when rotated to said first position, said pummel extends up between the legs and near the crotch of an occupant seated in the chair, thereby preventing the occupant from sliding too far down in and out of the chair because the pummel acts as a stop;

means for releasably securing said pummel in said first position;

wherein said elongate member has an adjustable length;

wherein said first and second frame portions are positioned at respective angles relative to said seat of said chair, and wherein said elongate member has a first end for engaging with said first frame portion and a second end for engaging with said second frame portion, wherein said first and second ends are adapted to engage with said frame portions disposed at angles other than said respective angles; and, wherein each said end of said elongate member terminates in a rotatable bracket.

2. The combination as set forth in claim 1 further comprising means for releasably fixing said each rotatable bracket in one of a plurality of fixed positions.

3. A combination of a chair with a device for restraining an occupant in the chair, said chair having a frame and a seat on said frame, said frame having first and second frame portions proximate opposite sides of said seat, and said seat having a front edge; said restraining device comprising:

an elongate member, axially disposed between said first and second frame portions, for engaging said frame;

a pummel, rotatably mounted on said elongate member, for rotation about said elongate member between a first position at the front edge and above said seat, and a second position lower than said seat, said pummel being shaped and arranged such that, when rotated to said first position, said pummel extends up between the legs and near the crotch of an occupant seated in the chair, thereby preventing the occupant from sliding too far down in and out of the chair because the pummel acts as a stop;

means for releasably securing said pummel in said first position;

wherein said elongate member has an adjustable length; and, wherein said elongate member comprises a conduit having a first end and a second end, a first arm and bracket assembly supported in said first end of said conduit, and a second arm and bracket assembly supported in said second end of said conduit, said first and second brackets of said arm and bracket assemblies for engaging said first and second frame portions, respectively.

4. The combination as set forth in claim 3 further comprising first and second buttressing members position through said conduit proximate opposite sides of said pummel, a first spring having one end thereof abutting said first buttressing member and an opposite end thereof abutting said arm of said first arm and bracket assembly, and a second spring having one end thereof abutting said second buttressing member and an opposite end thereof abutting said arm of said second arm and bracket assembly.

5. The combination as set forth in claim 1 wherein said pummel is comprised of a head portion and a neck portion, and wherein said elongate axis member is positioned through said neck portion of said pummel, said neck portion being proximate a frontal edge of said seat of said chair when said pummel is in said first position and at least a portion of said head portion overlying an upper surface of said seat when said pummel is in said first position.

6. A device for restraining an individual in a given chair of the type that has a frame and a seat on the frame, which frame includes first and second frame portions proximate opposite sides of the seat, and which seat includes a front edge; said restraining device comprising:

an elongate conduit having a first end and a second end;

a first engaging element, supported within said first end of said elongate conduit, adapted for engaging the first frame portion of the given chair;

a second engaging element, supported within said second end of said elongate conduit, adapted for engaging the second frame portion of the given chair; and a wedge element, rotatably engaged with said elongate conduit at the center of said elongate conduit, for rotation about said elongate conduit between a restraining position and a non-restraining position;

said wedge element being shaped and arranged such that, when rotated to the restraining position, the wedge element extends between the legs and near the crotch of an individual who is seated in the given chair, thereby preventing such a seated individual from sliding too far down in and out of the given chair because the wedge element acts as a stop.

7. The device as set forth in claim 6 including means for releasably securing said wedge element in said restraining position.

8. The device as set forth in claim 7 wherein said securing means comprises a depressible button member mounted within said conduit, an aperture in said conduit, and an aperture in said wedge element, wherein said button member extends through said apertures when said apertures are aligned, thereby securing said wedge element in a fixed position with respect to said conduit.

9. The device as set forth in claim 6 wherein at least one of said first and second engaging elements is longitudinally moveable relative to said conduit.

10. The device as set forth in claim 9 further comprising a spring retained within said conduit in abutting relationship with said at least one engaging element is adapted for resiliently biasing said at least one engaging element outwardly into engagement with a corresponding frame portions of the given chair.

11. A device for restraining an individual in a given chair of the type that has a frame and a seat on the frame, which frame includes first and second frame portions proximate opposite sides of the seat, and which seat includes a front edge; wherein said restraining device comprises:

an elongate conduit having a first end and a second end;

a first engaging element, supported within said first end of said elongate conduit, adapted for engaging the first frame portion of the given chair;

a second engaging element, supported within said second end of said elongate conduit, adapted for engaging the second frame portion of the given chair; and a wedge element, rotatably engaged with said elongate conduit at the center of said elongate conduit, for rotation about said elongate conduit between a restraining position and a non-restraining position;

wherein said engaging elements are rotatable adapted to engage with first and second frame portions said restraining device further comprising means for releasably fixing said engaging elements in a fixed position.

* * * * *